US007976315B2

(12) United States Patent
Zuinen et al.

(10) Patent No.: US 7,976,315 B2
(45) Date of Patent: Jul. 12, 2011

(54) RECEPTACLE WITH AN INNER CONDUCTOR SURROUNDED BY AN OUTER CONDUCTOR AND AN INSULATOR HAVING OVERHUNG PORTIONS

(75) Inventors: Takao Zuinen, Ritto (JP); Ryo Matoba, Ritto (JP); Makoto Kitamura, Omihachiman (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/862,464

(22) Filed: Aug. 24, 2010

(65) Prior Publication Data

US 2011/0053411 A1 Mar. 3, 2011

(30) Foreign Application Priority Data

Aug. 25, 2009 (JP) ..... 2009-194737
Jun. 8, 2010 (JP) ..... 2010-130626

(51) Int. Cl.
*H01R 12/00* (2006.01)

(52) U.S. Cl. ..... 439/63

(58) Field of Classification Search ..... 439/63, 439/578, 581, 944
See application file for complete search history.

(56) References Cited

U.S. PATENT DOCUMENTS

| | | | | |
|---|---|---|---|---|
| 4,334,327 | A * | 6/1982 | Lyman et al. | 623/23.66 |
| 6,474,995 | B1 * | 11/2002 | Wu | 439/63 |
| 6,902,408 | B2 * | 6/2005 | Yamane | 439/63 |
| D513,606 | S * | 1/2006 | Yamane | D13/149 |
| 7,651,334 | B2 * | 1/2010 | Zhang | 439/63 |
| 2004/0137764 | A1 * | 7/2004 | Yamane | 439/63 |
| 2005/0255747 | A1 * | 11/2005 | Yamane | 439/583 |
| 2008/0268705 | A1 * | 10/2008 | Yamane | 439/578 |

FOREIGN PATENT DOCUMENTS

JP 2004-221055 A 8/2004

* cited by examiner

*Primary Examiner* — Chandrika Prasad
(74) *Attorney, Agent, or Firm* — Studebaker & Brackett PC; Tim L. Brackett, Jr.

(57) ABSTRACT

Described herein is a receptacle for coaxial connector whose outer shape is made small and short in height while ensuring reliability. The receptacle for coaxial connector includes an outer conductor having a tubular portion, a central conductor having a contact portion extending in an axis direction in an internal space of the tubular portion, and an insulator holding the outer conductor and the central conductor in an insulating state. A region of the central conductor other than a central-conductor drawing portion thereof has outwardly projected portions in planar view of the central conductor.

9 Claims, 7 Drawing Sheets

RECEPTACLE WITH AN INNER CONDUCTOR SURROUNDED BY AN OUTER CONDUCTOR AND AN INSULATOR HAVING OVERHUNG PORTIONS

CROSS REFERENCE TO RELATED APPLICATIONS

The present application claims priority to Japanese Patent Application No. 2009-194737 filed Aug. 25, 2009, and to Japanese Patent Application No. 2010-130626 filed Jun. 8, 2010, the entire contents of these applications being incorporated herein by reference in their entirety.

FIELD OF THE INVENTION

The inventions relate to a receptacle for coaxial connector, and more particularly, to a receptacle for coaxial connector whose outer shape is small and short in height.

BACKGROUND

As a receptacle for coaxial connector used for transmission of a high-frequency signal, for example, Japanese Unexamined Patent Publication No. 2004-221055 discloses a structure based on FIGS. 1A and 1B.

This receptacle for coaxial connector 1 has an exterior conductor 10 having a cylindrical portion, and a central conductor 20 including a contact portion extending in an axis line direction in an internal space of the cylindrical portion. The receptacle 1 is structured to integrally hold both the external conductor 10 and the central conductor 20 through a molded dielectric body (insulator) 30 in a lower section between both the conductors 10 and 20.

A lock groove 13 as a stopper of a plug is formed in the cylindrical portion of the external conductor 10. Further, in order to prevent the central conductor 20 from coming off from the dielectric body (insulator) 30 in a back surface direction by a stress at the time of plug attachment, a surface worked portion (recessed portion) 22A is provided in an inward end portion of the central conductor 20.

In the structure described in Japanese Unexamined Patent Publication No. 2004-221055, a resin is molded so as to cover an upper portion of the external conductor, and thus, a thickness of the external conductor and a thickness of the resin are accumulated, which increases outer dimensions of the product.

Further, a position of the lock groove 13 provided in the cylindrical portion of the external conductor as the stopper of the plug becomes higher by the accumulated thickness of the resin, which also increases a whole height in a state where the plug is attached to the receptacle.

Furthermore, there is a problem that a distance between the lock groove 13 of the cylindrical portion of the external conductor 10 and an upper surface of the dielectric body (insulator) 30, which is a height needed to attach the plug, cannot be ensured.

SUMMARY

Embodiments consistent with the claimed invention provide a receptacle for coaxial connector in which an outer shape thereof can be made small and short in height while ensuring reliability.

In accordance with an embodiment of the invention, a receptacle for coaxial connector includes an outer conductor having a tubular portion, a central conductor having a contact portion extending in an axis direction in an internal space of the tubular portion of the outer conductor, an insulator holding the outer conductor and the central conductor in an insulating state, and an overhanging region made of the outer conductor and the insulator and overhanging in a surface direction perpendicular to the axis direction of the tubular portion of the outer conductor. The outer conductor has an outer-conductor overhanging portion, which is arranged in the overhanging region, and overhangs outward from a bottom of the tubular portion in the surface direction perpendicular to the axis direction of the tubular portion except for a predetermined section. The central conductor has a central-conductor drawing portion, which is arranged in the predetermined section inside the overhanging region, and is drawn out in a direction perpendicular to the axis direction of the tubular portion. The insulator has an insulator overhanging portion, which is arranged in the predetermined section inside the overhanging region, and partially covers the central-conductor drawing portion. In a plan view of the central conductor, a region other than the central-conductor drawing portion of the central conductor has a site projected in a radial direction and a non-projected site.

According to a more specific exemplary embodiment, the receptacle for coaxial connector may have a through-hole in the site projected in the radial direction.

In another more specific exemplary embodiment, the site projected in the radial direction may be a wing-like projected portion.

In accordance with another embodiment of the invention, a receptacle for coaxial connector includes an outer conductor having a tubular portion with a center axis, a central conductor having a contact portion extending in a first direction of the center axis and surrounded by the tubular portion, and an insulator provided between the central conductor and the outer conductor to form an integrated structure and insulate the central conductor from the outer conductor. The central conductor has a central-conductor drawing portion extending outboard of the tubular portion in a second direction perpendicular to the center axis and plural members projecting outward about the center axis in said second direction.

In yet another embodiment of the invention, a receptacle for coaxial connector includes an outer conductor having a tubular portion with a center axis, a central conductor having a contact portion extending in a first direction of the center axis and surrounded by the tubular portion, and an insulator provided between the central conductor and the outer conductor to form an integrated structure and insulate the central conductor from the outer conductor. The central conductor has a central-conductor drawing portion extending outboard of the tubular portion in a second direction perpendicular to the center axis, and plural through-holes in a portion surrounding the contact portion with the insulator provided in the through-holes.

These structures increase a contact area of the central conductor with the insulator, so that the central conductor can be prevented from coming off from the insulator.

Accordingly, a receptacle for coaxial connector can be constructed small and short in height with a high mechanical strength.

BRIEF DESCRIPTION OF THE DRAWINGS

FIG. 2A shows a state where both are separated, and FIG. 2B shows a state where both are attached.

FIG. 3A is an exploded perspective view of the receptacle, FIG. 3B is a perspective view of the whole receptacle, FIG. 3C is a cross-sectional view of the receptacle taken along straight line X-X of FIG. 3B, and FIG. 3D is a cross-sectional view of the receptacle taken along straight line Y-Y of FIG. 3B.

DETAILED DESCRIPTION

A configuration of a receptacle for coaxial connector according to a first exemplary embodiment is described with reference to FIGS. 2 to 5.

Figure 2A:
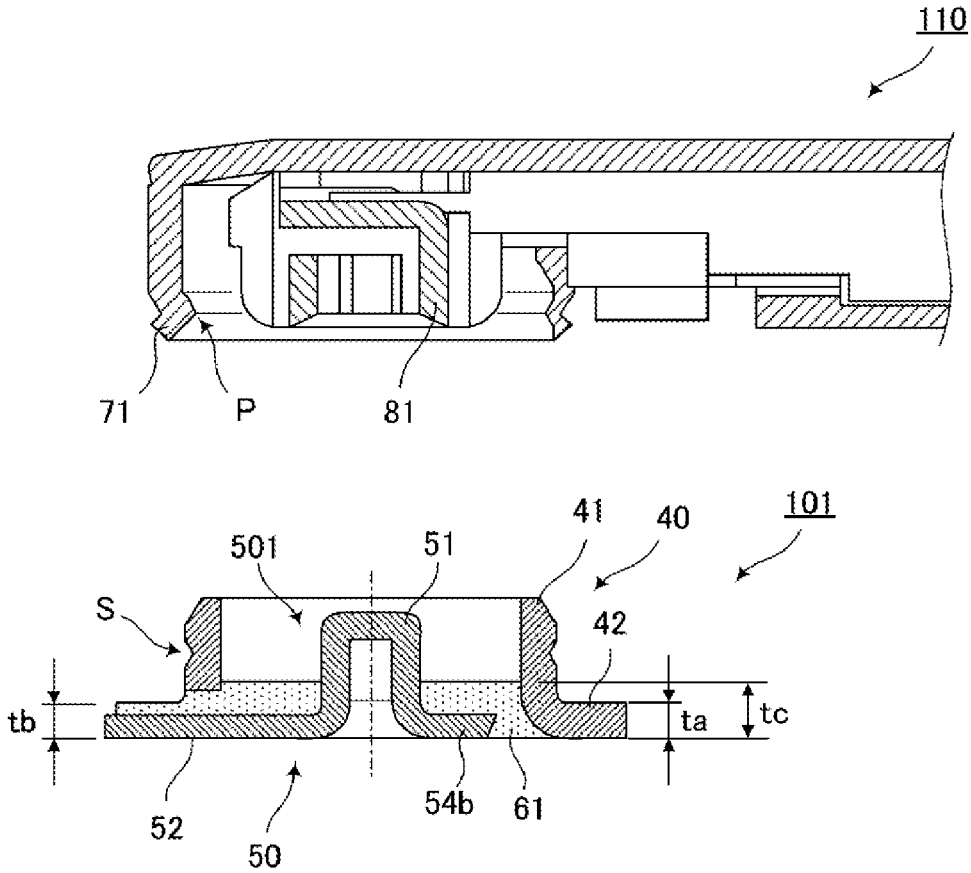
FIGS. 2A and 2B are cross-sectional views of an exemplary receptacle for coaxial connector and a connectable plug for coaxial connector, where
Figure 2B:
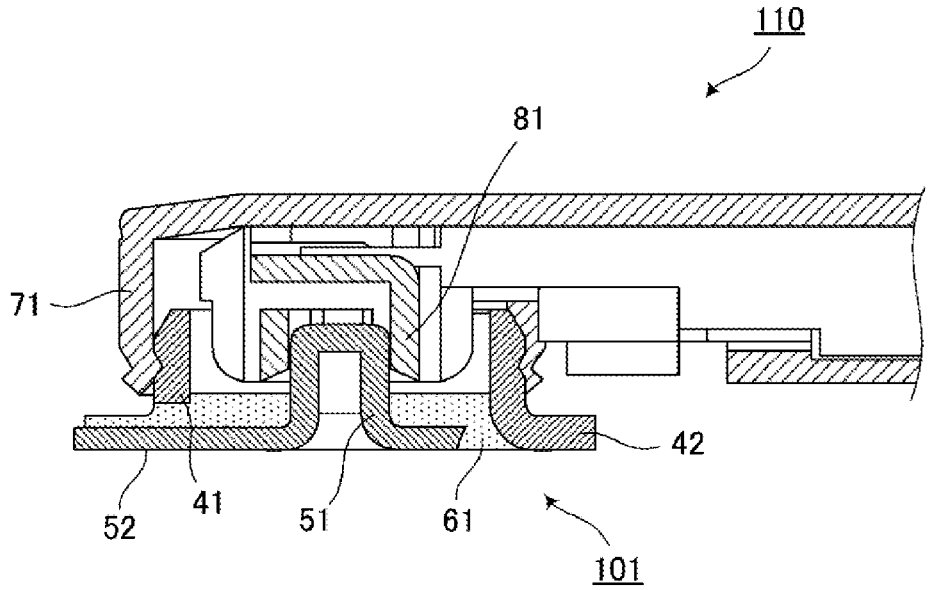

FIGS. 2A to 2B are cross-sectional views of a receptacle for coaxial connector (hereinafter, simply referred to as a receptacle) 101 and a plug for coaxial connector (hereinafter, simply referred to as a plug) 110 to be attached to or detached from the same. FIG. 2A shows a state where the receptacle 101 and the plug 110 are separated, and FIG. 2B shows a state where they are attached.

The receptacle 101 includes an outer conductor 40 having a tubular portion 41, a central conductor 501 having a contact portion 51 extending in an axis direction in an internal space of the tubular portion 41 of the outer conductor 40, and an insulator 61 holding the outer conductor 40 and the central conductor 501 in an insulating state.

The central conductor 501 includes a central-conductor drawing portion 52, which is drawn out in a direction perpendicular to an axis (shown as an alternating long and short dash line) direction of the tubular portion of the outer conductor 40. Moreover, the outer conductor 40 includes an outer-conductor overhanging portion 42, which overhangs outward from a bottom of the tubular portion 41 in directions perpendicular to the axis direction of the tubular portion 41 of the outer conductor 40 except for (so as to avoid) a position through which the central-conductor drawing portion 52 passes.

As will be described later, an overhanging region extending in the perpendicular directions from the tubular portion 41 of the outer conductor 40 includes a region where an insulator overhanging portion of the insulator 61 exists, and a region where the outer-conductor overhanging portions 42 exists when seen in a thickness direction. A thickness dimension tb of the insulator overhanging portion and a thickness dimension to of the outer-conductor overhanging portion 42 are almost the same.

Also, a thickness dimension of a section of the central-conductor drawing portion 52 including a thickness of the insulator is the same as the thickness dimension tb of the insulator overhanging portion.

The plug 110 includes an outer conductor 71 and an inner conductor 81, and in the state where the plug 110 is attached to the receptacle 101 as shown in FIG. 2B, the outer conductor 71 of the plug 110 comes into contact with the tubular portion 41 of the outer conductor 40 of the receptacle 101, and the inner conductor 81 of the plug 110 comes into contact with the contact portion 51 of the central conductor 501 of the receptacle 101.

As shown in FIG. 2A, a groove S is formed in an outer circumferential surface of the tubular portion 41 of the outer conductor 40, and a protruded portion P is formed in an inner circumferential surface of the outer conductor 71 of the plug 110, respectively, so that both are engaged.

In this manner, since the thickness dimension tb of the overhanging portion of the insulator 61 is almost equal to the thickness dimension to of the outer-conductor overhanging portion 42 and the section of the central-conductor drawing portion 52, a distance between a lower end surface of the outer conductor 71 of the plug 110, and upper surfaces of the outer-conductor overhanging portion 42 and the section of the central-conductor drawing portion 52 of the receptacle 110 can be sufficiently ensured.

Figure 3A:
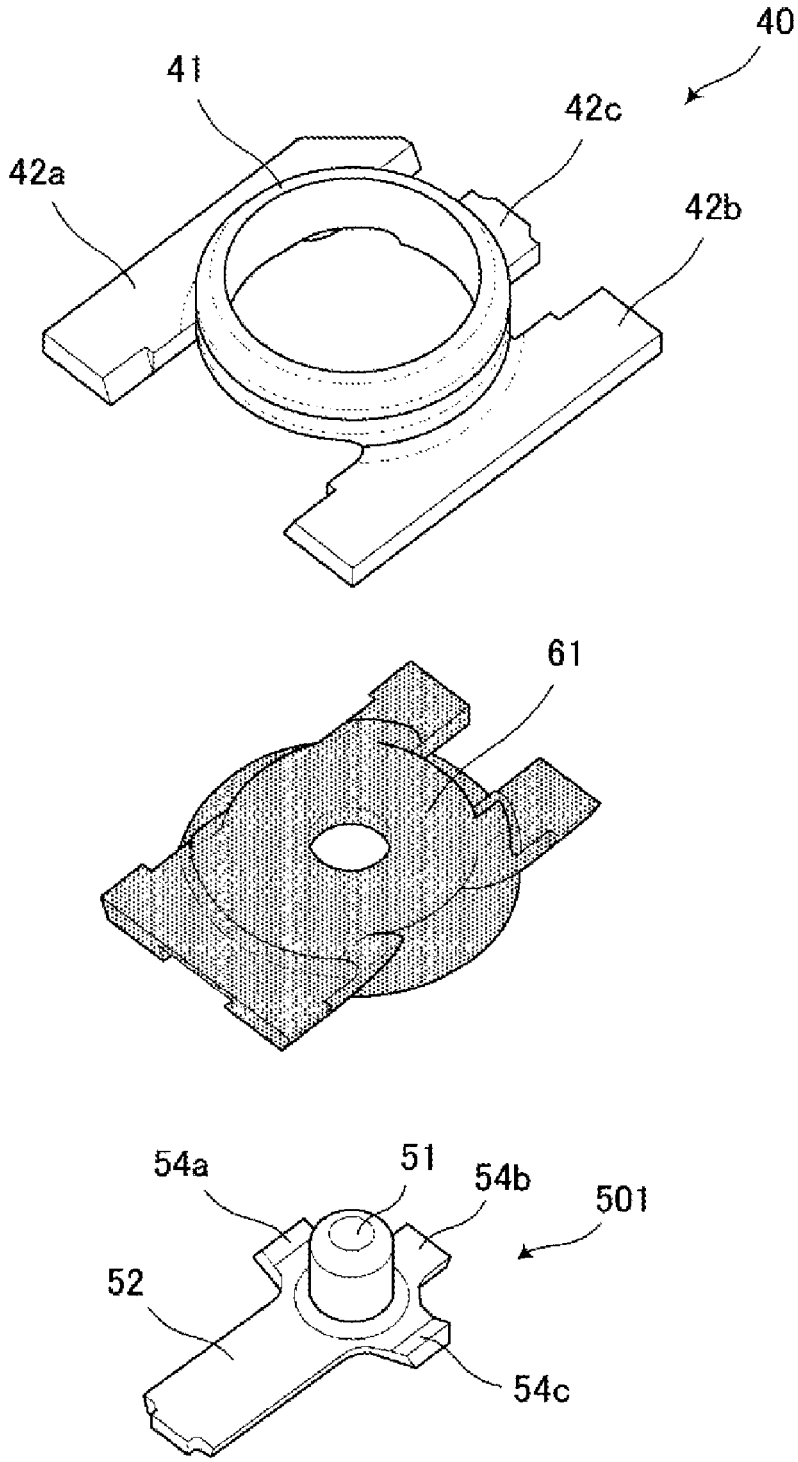
FIGS. 3A to 3D are views showing an exemplary configuration of the receptacle shown in FIGS. 2A and 2B, where
Figure 3B:
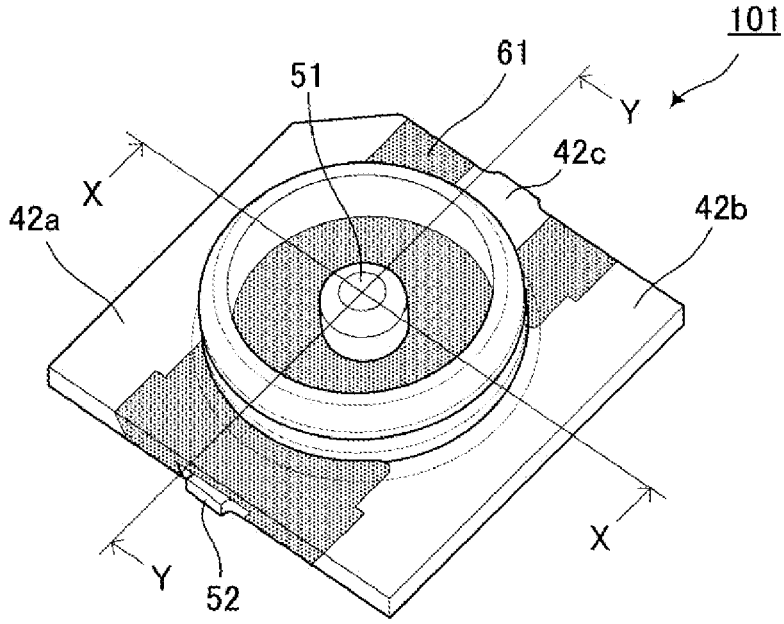
Figure 3C:
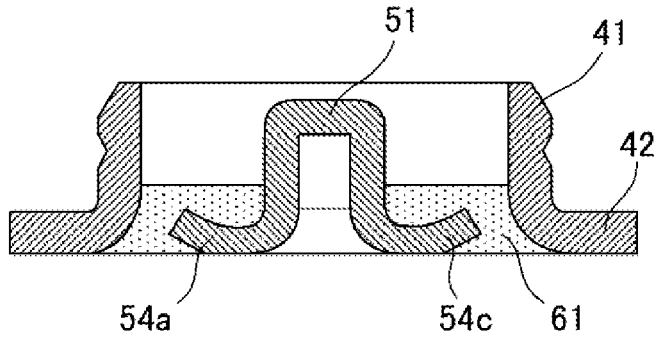
Figure 3D:
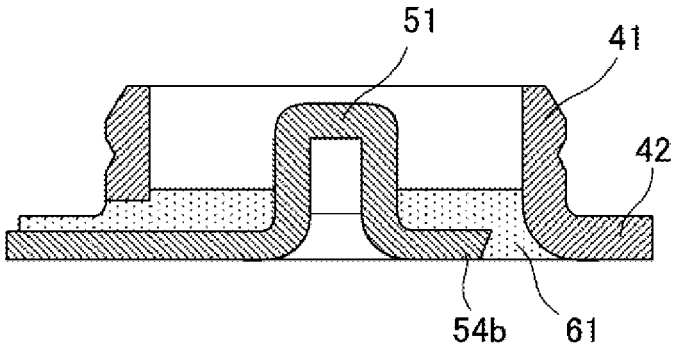

FIGS. 3A to 3D are views showing a configuration of the receptacle 101, FIG. 3A being an exploded perspective view of the receptacle, FIG. 3B being a perspective view of the whole receptacle 101, FIG. 3C being a cross-sectional view of the receptacle 101, going through a center in a lateral direction of the central conductor 501 (along a straight line X-X in FIG. 3B), and FIG. 3D being a cross-sectional view of the receptacle 101, going through a center in a longitudinal direction of the central conductor 501 (along a straight line Y-Y in FIG. 3B).

As shown in FIG. 3A, the outer conductor 40 includes the tubular portion 41, and outer-conductor overhanging portions 42*a*, 42*b* and 42*c* overhanging outward from the bottom of the tubular portion 41 in a surface direction perpendicular to the axis direction of this tubular portion 41. Moreover, the central conductor 501 includes the contact portion 51 extending in the axis direction in the internal space of the tubular portion 41 of the outer conductor 40, and the central-conductor drawing portion 52, which is drawn out in the direction perpendicular to the axis direction of the tubular portion 41 of the outer conductor 40.

The outer-conductor overhanging portions 42*a*, 42*b*, 42*c* of the outer conductor 40 are formed except for (so as to avoid) the position through which the central-conductor drawing portion 52 passes.

The insulator 61 has a shape that holds the outer conductor 40 and the central conductor 501 in an insulating state by resin molding, and has the insulator overhanging portion in a region where the outer-conductor overhanging portions 42*a*, 42*b*, 42*c* do not exist. Moreover, the insulator overhanging portion partially covers the central conductor drawing portion 52.

As shown in FIG. 3B, the overhanging region (substantially square) extending in the perpendicular directions from the tubular portion 41 of the outer conductor 40 includes the region where only the insulator overhanging portion of the insulator 61 exists, and the region where only the outer-conductor overhanging portions 42*a*, 42*b*, 42*c* exist when seen in the thickness direction. That is, on the upper surfaces of the outer-conductor overhanging portions 42*a*, 42*b*, 42*c*, the insulator is not arranged. Accordingly, the thickness of the insulating overhanging portion of the insulator 61 and the thickness of the outer-conductor overhanging portions 42*a*, 42*b*, 42*c* are almost the same.

Figure 1A:
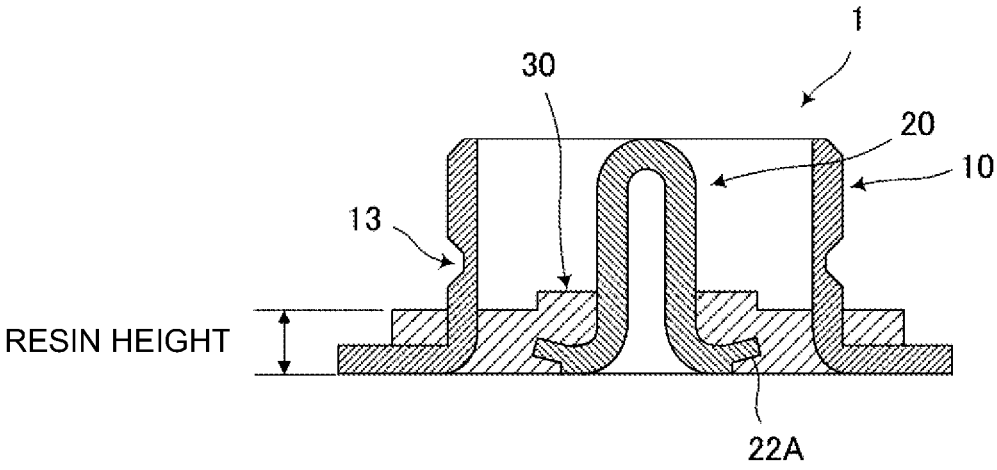
FIG. 1A Prior Art
FIGS. 1A and 1B are cross-sectional views of a receptacle for coaxial connector described in Japanese Unexamined Patent Publication No. 2004-221055.
Figure 1B:
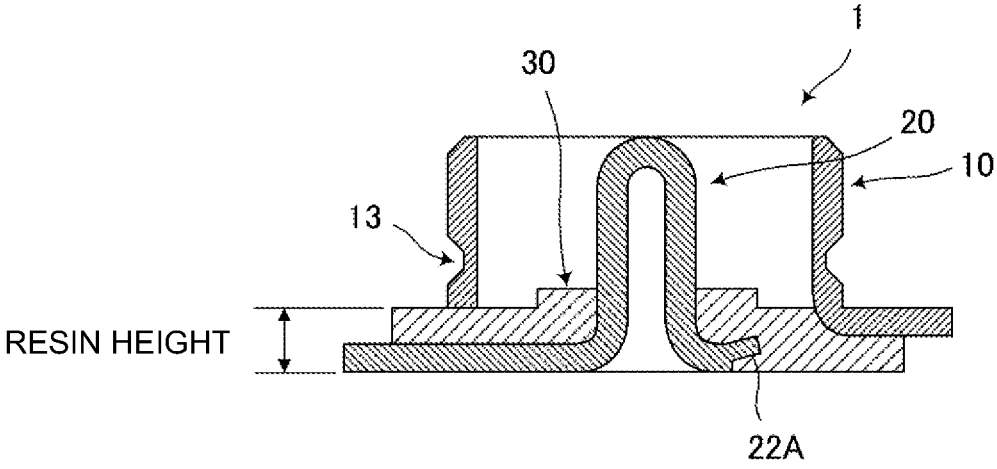
FIG. 1B Prior Art

The above-described structure can reduce a height from a bottom surface of the receptacle to the upper surface of the insulator overhanging portion, thereby decreasing the thickness of the overhanging region, which dominates the outer shape of the receptacle. For example, while in the conventional structure shown in FIG. 1, a height dimension of the receptacle is 0.27 mm, it can be reduced to 0.12 mm according to this embodiment. With this, the outer shape of the product can be made small and short in height.

Moreover, a cavity needs to be formed in the conventional structure by working in order to mold the resin on an upper surface of a terminal. By contrast, a shape of the insulator (resin) in embodiments consistent with the claimed invention is simple, which can cut a manufacturing cost of a metal mold.

Furthermore, the resin is molded in the conventional structure on the upper surface of the terminal, resulting in complicated resin flow. In embodiments consistent with the claimed invention, the shape of the insulator (resin) is simple, which makes it difficult to cause defective molding (short shot) by entangled air or the like.

As shown in FIG. 2, a thickness dimension tc of the insulator 61 inside the outer-conductor tubular portion 41 is larger than the thickness dimension tb of the insulator 61 in a region outside the outer-conductor tubular portion 41. This increases integration strength of the insulator 61 and the central conductor 501.

Figure 4:
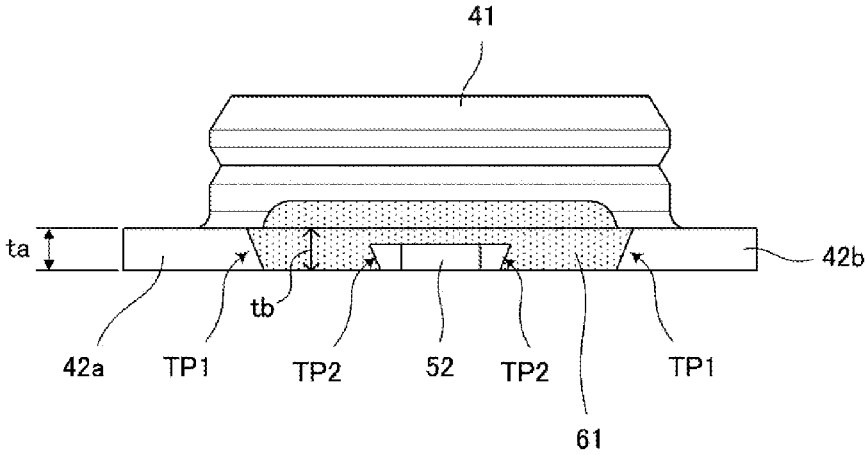
FIG. 4 is a front view when seen from a drawing direction of a central-conductor drawing portion.

FIG. 4 is a front view when seen from a drawing direction of the central-conductor drawing portion 52. As shown FIG. 4, there are provided taper portions TP1 in which a cross-sectional shape of border portions between the insulator 61 and the outer-conductor overhanging portions 42*a*, 42*b* is a shape tapered from the upper surfaces of the outer-conductor overhanging portions 42*a* to lower surfaces thereof, 42*b*. This shape is similar in a relationship between the outer-conductor overhanging portion 42*c* and the insulator 61 shown in FIGS. 3A to 3D.

Moreover, there are also provided taper portions TP2 in which a cross-sectional shape of border portions between the insulator 61 and the center-conductor drawing portion 52 is a shape tapered from a lower surface of the central-conductor drawing portion 52 to an upper surface thereof.

The above-described structure allows the central-conductor drawing portion 52 to be locked with the insulator 61, thereby preventing the central-conductor drawing portion 52 from coming off from the insulator 61 in a bottom surface direction. Similarly, the insulator 61 is locked with the outer-conductor overhanging portions 42*a*, 42*b*, thereby preventing the insulator 61 from coming off in the bottom surface direction. It is true of the outer-conductor overhanging portion 42*c* in the center.

Figure 5A:
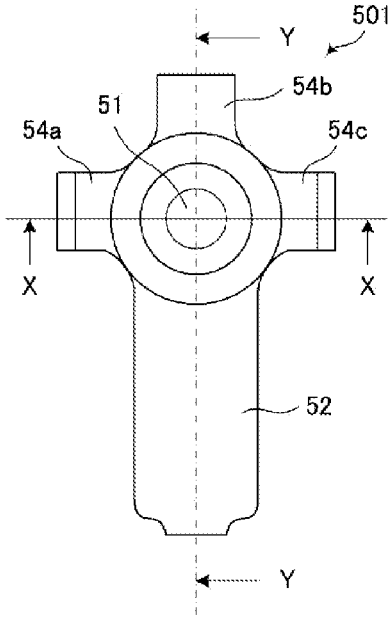
FIG. 5A is a top view of the central conductor.
Figure 5D:
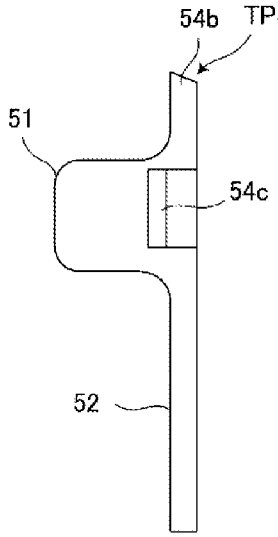
FIG. 5D is a right side view of the same.
Figure 5E:
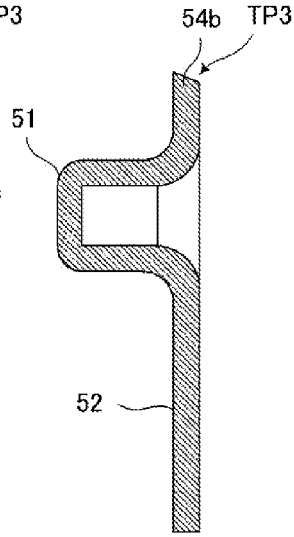
FIG. 5E is a cross-sectional view along a straight line Y-Y shown in FIG. 5A.
Figure 5B:
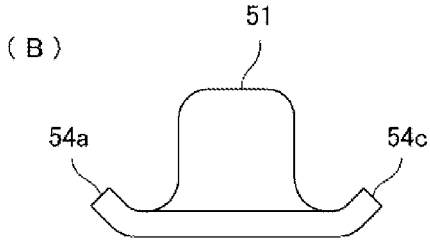
FIG. 5B is a front view of the same.
Figure 5C:
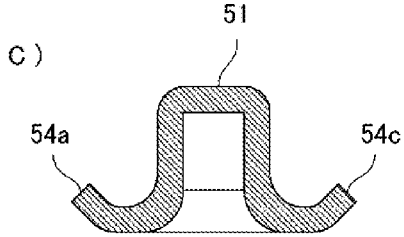
FIG. 5C is a cross-sectional view along a straight line X-X shown in FIG. 5A.

FIG. 5A is a top view of the central conductor 501, FIG. 5B is a front view of the same, FIG. 5C is a cross-sectional view along a straight line X-X shown in FIG. 5A, FIG. 5D is a right side view of the same, and FIG. 5E is a cross-sectional view along a straight line Y-Y shown in FIG. 5A.

The central conductor 501 has wing-like projected portions 54*a*, 54*b*, 54*c* in planar view of the central conductor 501 in a region other than the central-conductor drawing portion 52.

The above-described structure increases a contact area of the central conductor 501 with the insulator 61, thereby enhancing an anchor effect to surely prevent the central conductor 501 from coming off from the insulator 61.

Moreover, the projected portions 54*a*, 54*c* of the central conductor 501 each have terminal ends warped upward. Furthermore, in a terminal end portion of the projected portion 54*b*, there is provided a taper portion TP3 in which a cross-sectional shape of a border portion with the insulator 61 is a tapered shape from a lower surface to an upper surface. Thus, even if a downward stress is applied to the central conductor 501, the projected portions 54*a*, 54*c* are surely locked with the insulator 61. Thus, the central conductor 501 can be surely prevented from coming off downward.

Furthermore, since the projected portions 54*a*, 54*b*, 54*c* and the insulator 61 are engaged, displacement in a rotational direction with the contact portion 51 of the central conductor 501 serving as a central axis is hardly caused. When the plug is separated from the receptacle, even if the plug is separated while rotating the same, the central conductor 501 can be prevented from being separated from the insulator 61.

Since the warped shape of the projected portions 54*a*, 54*c* is formed by bending work, the thickness is constant. As a result, the strength of these portions that come into a contact with, and are engaged with the insulator, is not decreased.

The structure described above can prevent the central conductor 501 and the insulator 61 from coming off from the outer conductor 40 by the stress when the plug 110 shown in FIGS. 2A and 2B is attached.

Embodiments of the outer conductor 40 and the central conductor 501 do not need to be formed into complicated shapes (embossed shapes) in order to prevent the slip-off of the central conductor from the insulator and the slip-off of the insulator from the outer terminal at the time of plug insertion, and thus the end surfaces of the outer-conductor overhanging portions 42, the central-conductor drawing portion 52, and the wing-like projected portions 54*a*, 54*b*, 54*c* can be easily molded by press molding such as coining process, swaging process, side force process and the like.

Figure 6:
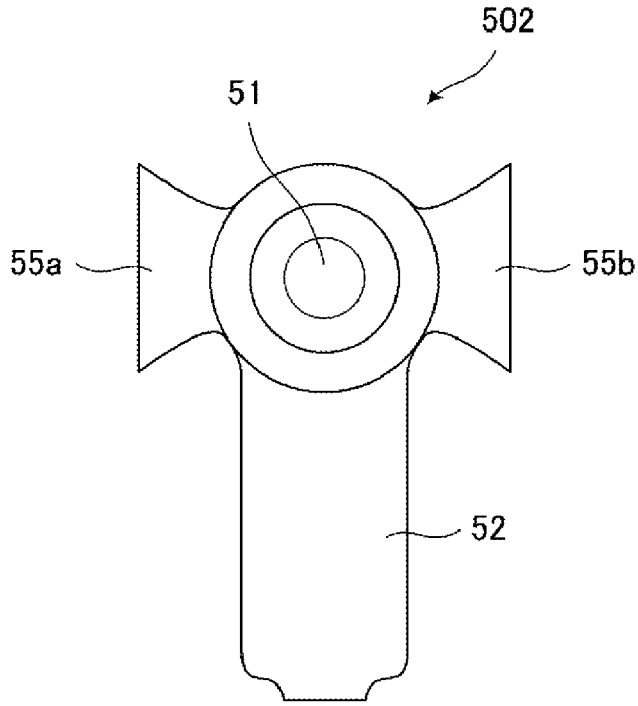
FIG. 6 is a top view of a central conductor included by a receptacle according to a second exemplary embodiment.

FIG. 6 is a top view of a central conductor 502 including a receptacle according to a second exemplary embodiment.

The central conductor 502 includes the contact portion 51 extending in the axis direction in the internal space of the tubular portion of the outer conductor (not shown in FIG. 6), and the central-conductor drawing portion 52 is drawn out in the direction perpendicular to the axis direction of the tubular portion of the outer conductor.

Moreover, the central conductor 502 has wing-like projected portions 55*a*, 55*b* in planar view of the central conductor 502 in the region other than the central-conductor drawing portion 52. The wing-like projected portions 55*a*, 55*b* are each formed into a battledore shape, whose terminal end expands.

The other configurations are similar to those described in the first exemplary embodiment.

The above-described structure increases a contact area of the central conductor 502 with the insulator, so that the central conductor 502 can be surely prevented from coming off and being separated from the insulator.

Figure 7:
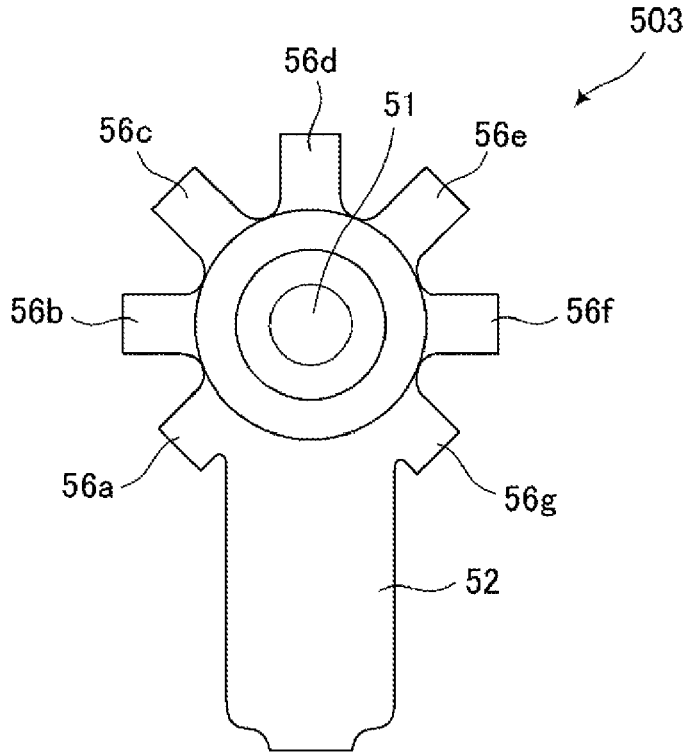
FIG. 7 is a top view of a central conductor included by a receptacle according to a third exemplary embodiment.

FIG. 7 is a top view of a central conductor 503 included by a receptacle according to a third exemplary embodiment.

The central conductor 503 includes the contact portion 51 extending in the axis direction in the internal space of the tubular portion of the outer conductor (not shown in FIG. 7), and the central-conductor drawing portion 52 is drawn out in the direction perpendicular to the axis direction of the tubular portion of the outer conductor.

Moreover, the central conductor 503 has wing-like projected portions 56*a*, 56*b*, 56*c*, 56*d*, 56*e*, 56*f*, and 56*g* provided in a substantially radial arrangement in planar view of the central conductor 503 in the region other than the central-conductor drawing portion 52.

The other configurations are similar to those described in the first exemplary embodiment.

The above-described structure increases a contact area of the central conductor 503 with the insulator, so that the central conductor 503 can be surely prevented from coming off and being separated from the insulator.

Figure 8A:
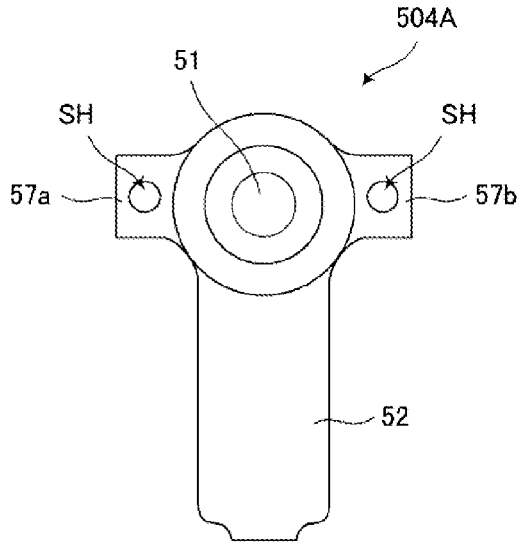
FIGS. 8A and 8B are top views of central conductors respectively included by a receptacle according to a fourth exemplary embodiment.
Figure 8B:
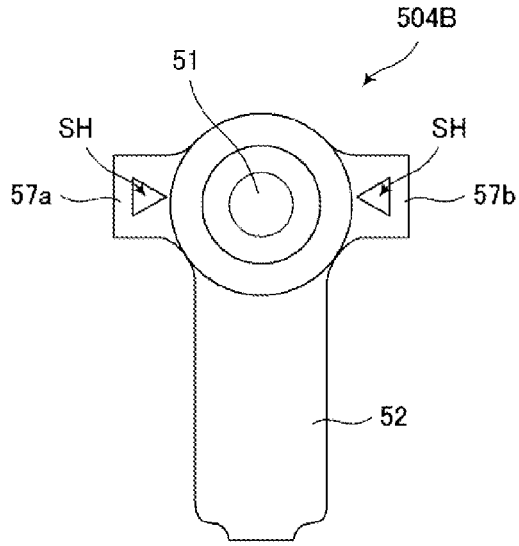

FIGS. 8A, 8B are top views of respective central conductors 504A, 504B included by a receptacle according to a fourth exemplary embodiment.

The central conductors 504A, 504B shown in FIGS. 8A, 8B each include the contact portion 51 extending in the axis direction in the internal space of the tubular portion of the outer conductor (not shown in FIGS. 8A and 8B), and the central-conductor drawing portion 52 is drawn out in the direction perpendicular to the axis direction of the tubular portion of the outer conductor.

Moreover, the central conductors 504A, 504B each have wing-like projected portions 57*a*, 57*b* in planar view of the central conductors 504A, 504B in the region other than the central-conductor drawing portion 52.

In each of the projected portions 57*a*, 57*b* of the central conductor 504A, circular through-holes SH are formed. In each the projected portions 57*a*, 57*b* of the central conductor 504B, triangular through-holes SH are formed.

The other configurations are similar to those described in the first exemplary embodiment.

Since in the above-described configurations, the insulator (resin) is filled into the through-holes SH, inner surfaces of the through-holes SH act effectively, and thus, contact areas between the central conductors 504A, 504B and the insulators are increased, so that the central conductors 504A, 504B can be surely prevented from coming off and being separated from the insulators.

Figure 9:
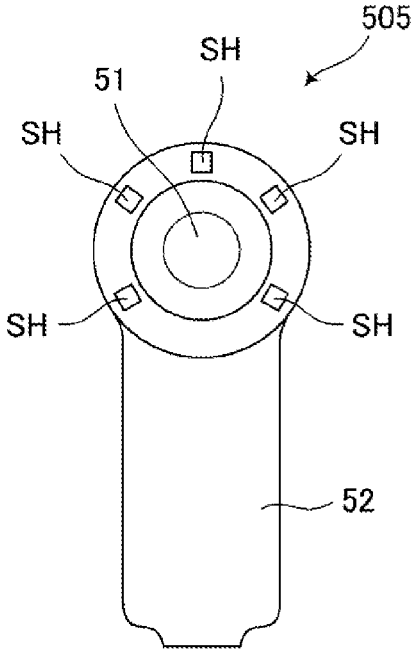
FIG. 9 is a top view of a central conductor included by a receptacle according to a fifth exemplary embodiment.

FIG. 9 is a top view of a central conductor 505 included by a receptacle according to a fifth exemplary embodiment.

The central conductor 505 shown in FIG. 9 includes the contact portion 51 extending in the axis direction in the internal space of the tubular portion of the outer conductor, and the central-conductor drawing portion 52 (not shown in FIG. 9) is drawn out in the direction perpendicular to the axis direction of the tubular portion of the outer conductor. In a flange-like portion around the contact portion 51, a plurality of through-holes SH are arranged radially.

The other configurations are similar to those described in the first exemplary embodiment.

Since in the above-described configuration, the insulator (resin) is filled into the through-holes SH, inner surfaces of the through-holes SH act effectively, and thus the contact area between the central conductor 505 and the insulator is increased. Accordingly, the central conductor 505 can be prevented from coming off and being separated from the insulator.

Figure 10:
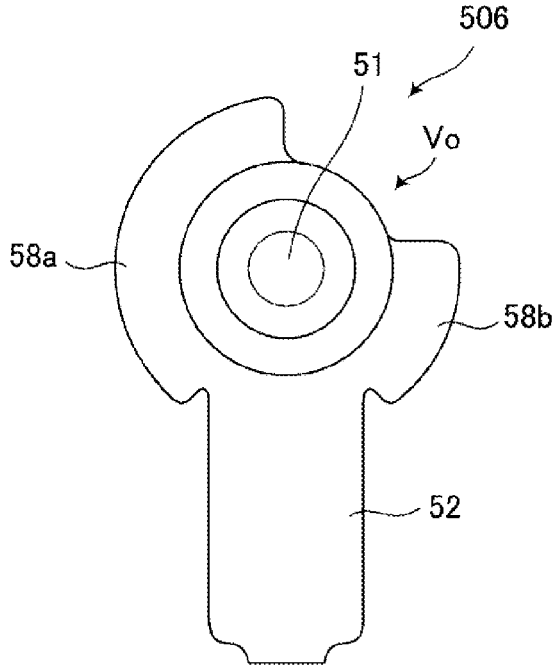
FIG. 10 is a top view of a central conductor included by a receptacle according to a sixth exemplary embodiment.

FIG. 10 is a top view of a central conductor 506 included by a receptacle according to a sixth exemplary embodiment.

The central conductor 506 includes the contact portion 51 extending in the axis direction in the internal space of the tubular portion of the outer conductor (not shown in FIG. 10), and the central-conductor drawing portion 52 is drawn out in the direction perpendicular to the axis direction of the tubular portion of the outer conductor.

Moreover, the central conductor 506 has projected sites 58*a*, 58*b*, which are projected in a radial direction outward from the center of the central conductor, and a non-projected site Vo in planar view of the central conductor 506 in the region other than the central-conductor drawing portion 52.

The other configurations are similar to those described in the first exemplary embodiment.

The through-holes as shown in the fourth exemplary embodiment or in the fifth exemplary embodiment can be formed in the projected sites 58*a*, 58*b*.

The above-described configuration increases a contact area of the central conductor 506 with the insulator, so that the central conductor 506 can be prevented from coming off and being separated from the insulator.

As shown in this sixth exemplary embodiment, the projected portions are not necessarily wing-like, but provision of a site projected in the radial direction and a non-projected site in planar view of the central conductor can be sufficient.

While preferred embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. A receptacle for coaxial connector comprising:

an outer conductor having a tubular portion;

a central conductor having a contact portion extending in an axis direction in an internal space of the tubular portion of the outer conductor;

an insulator holding the outer conductor and the central conductor in an insulating state; and an overhanging region, including a region made of the outer conductor and another region made of the insulator, overhanging in a surface direction perpendicular to the axis direction of the tubular portion of the outer conductor, wherein the outer conductor has an outer-conductor overhanging portion, which is arranged in the overhanging region, and overhangs outward from a bottom of the tubular portion in the surface direction perpendicular to the axis direction of the tubular portion except for a predetermined section, the central conductor has a central-conductor drawing portion, which is arranged in the predetermined section inside the overhanging region, and is drawn out in a direction perpendicular to the axis direction of the tubular portion, the insulator has an insulator overhanging portion, which is arranged in the predetermined section inside the overhanging region, and partially covers the central-conductor drawing portion, and in a plan view of the central conductor, a region other than the central-conductor drawing portion of the central conductor has a site projected in a radial direction and a non-projected site.

2. The receptacle for coaxial connector according to claim 1, having a through-hole in the site projected in the radial direction.

3. The receptacle for coaxial connector according to claim 1, wherein the site projected in the radial direction is a wing-like projected portion.

4. The receptacle for coaxial connector according to claim 2, wherein the site projected in the radial direction is a wing-like projected portion.

5. A receptacle for coaxial connector comprising:

an outer conductor having a tubular portion with a center axis;

a central conductor having a contact portion extending in a first direction of the center axis and surrounded by the tubular portion; and an insulator provided between the central conductor and the outer conductor to form an integrated structure and insulate the central conductor from the outer conductor;

wherein the central conductor has a central-conductor drawing portion extending outboard of the tubular portion in a second direction perpendicular to the center axis and plural members projecting outward about the center axis in said second direction.

6. The receptacle for coaxial connector according to claim 5, having a through-hole in each of the plural members.

7. The receptacle for coaxial connector according to claim 5, wherein each of the plural members is a wing-like projected portion.

8. The receptacle for coaxial connector according to claim 5, wherein each of the plural members is substantially surrounded by the insulator.

9. A receptacle for coaxial connector comprising:

an outer conductor having a tubular portion with a center axis;

a central conductor having a contact portion extending in a first direction of the center axis and surrounded by the tubular portion; and an insulator provided between the central conductor and the outer conductor to form an integrated structure and insulate the central conductor from the outer conductor;

wherein the central conductor has a central-conductor drawing portion extending outboard of the tubular portion in a second direction perpendicular to the center axis, and plural through-holes in a portion surrounding the contact portion with the insulator provided in the through-holes.

* * * * *